US011565384B2

(12) United States Patent
Hsieh

(10) Patent No.: US 11,565,384 B2
(45) Date of Patent: Jan. 31, 2023

(54) TOGGLER STRUCTURE FOR RATCHET WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 0 days.

(21) Appl. No.: 17/072,242

(22) Filed: Oct. 16, 2020

(65) Prior Publication Data

US 2021/0138615 A1 May 13, 2021

(30) Foreign Application Priority Data

Nov. 7, 2019 (TW) ..... 108140438

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 13/46; B25B 13/468
USPC ..... 81/60–63.2
See application file for complete search history.

(56) References Cited

U.S. PATENT DOCUMENTS 837,291 A * 12/1906 Elliott ..... B25B 13/463 81/63
3,901,106 A * 8/1975 Causey ..... B25B 13/46 81/111
7,032,478 B2 * 4/2006 Hu ..... B25B 13/463 81/124.3
7,938,043 B2 * 5/2011 Hu ..... B25B 13/463 81/63
8,763,498 B2 * 7/2014 Hsieh ..... B25B 13/463 81/63.2
9,815,179 B2 * 11/2017 Anderson ..... B25B 13/463
10,232,494 B2 * 3/2019 Yang ..... B25B 13/463
2005/0145075 A1 * 7/2005 Lee ..... B25B 13/463 81/63.2
2005/0235783 A1 * 10/2005 Shen ..... B25B 13/463 81/63.2
2005/0247167 A1 * 11/2005 Chaconas ..... B25B 13/463 81/63.2

(Continued)

OTHER PUBLICATIONS

Merriam-Webster: Synchronously Definition & Meaning (Year: 2022).*

*Primary Examiner* — Joseph J Hail
*Assistant Examiner* — Timothy Brady
(74) *Attorney, Agent, or Firm* — Guice Patents PLLC

(57) ABSTRACT

A toggler structure for a ratchet wrench includes an elongated toggler arranged between a locking member and a direction switch member of the ratchet wrench. The rear side of the toggler includes at least two connecting portions. At least two elastic elements are arranged between the connecting portions of the direction switch member and the toggler in order to provide an elastic force to push the toggler to abut against the locking member. The elongated toggler can be applied to a ratchet structure of a greater thickness in order to increase the structural strength and operational torque of the ratchet wrench. Furthermore, the elastic elements can provide a uniform elastic force in the length direction of the toggler, thereby allowing the locking member to engage with the ratchet structure properly.

14 Claims, 5 Drawing Sheets

(56) References Cited

U.S. PATENT DOCUMENTS

| | | | | |
|---|---|---|---|---|
| 2011/0265613 | A1* | 11/2011 | Hu | B25B 13/46 81/179 |
| 2011/0308360 | A1* | 12/2011 | Hu | B25B 13/46 81/179 |
| 2013/0228049 | A1* | 9/2013 | Shen | B25B 13/463 81/63.1 |
| 2013/0269488 | A1* | 10/2013 | Huang | B25B 13/463 81/60 |
| 2014/0020518 | A1* | 1/2014 | Huang | B25B 13/467 81/63.1 |
| 2014/0060259 | A1* | 3/2014 | Hu | B25B 23/0035 81/60 |
| 2015/0135909 | A1* | 5/2015 | Chen | B25B 13/463 81/63.2 |
| 2016/0008959 | A1* | 1/2016 | Hu | B25B 13/463 81/63.2 |
| 2016/0067848 | A1* | 3/2016 | Lee | B25B 13/463 81/63.1 |
| 2016/0129563 | A1* | 5/2016 | Hu | B25B 13/463 81/60 |
| 2016/0375561 | A1* | 12/2016 | Chen | B25B 13/463 81/63.2 |
| 2017/0072544 | A1* | 3/2017 | Wang | B25B 13/463 |
| 2018/0029202 | A1* | 2/2018 | Chou | B25B 13/04 |
| 2019/0314959 | A1* | 10/2019 | Chen | B25B 13/463 |

* cited by examiner

TOGGLER STRUCTURE FOR RATCHET WRENCH

BACKGROUND OF THE INVENTION

1. Technical Field

The present invention relates to a hand tool, and in particular, to a toggler structure for a ratchet wrench.

2. Description of Related Art

Ratchet wrenches are hand tools commonly used for rotating fasteners (bolts or nuts) or sleeves and can also be used for rotating fasteners at small angles. A known ratchet wrench includes: a head portion having an accommodating cavity therein; a ratchet mechanism comprising a ratchet, a locking teeth portion and a direction switch button; the direction switch button having an elastic element and a toggling piece elastically abutting against the locking teeth portion. The ratchet mechanism is received inside the accommodating cavity, and the direction switch button is able to switch direction. When the direction switch button switches the position, it utilizes the toggling piece to push the locking teeth portion to move in order to allow the locking teeth portion to engage with the ratchet at a different position, thereby changing the rotational direction of the ratchet.

Manufacturers in this field aim to increase the torque of known ratchet wrenches. For known ratchet wrenches, to increase its operational strength, the current feasible method is to increase the diameter or thickness of the ratchet in order to increase the overall volume to bear the force exerted thereon, thereby increasing the operational strength. Nevertheless, such technique of increasing the ratchet diameter can cause the diameter of the head portion of the ratchet wrench to increase, and if it is used in an environment of confined space, the overly large head portion of such ratchet wrench would not be able to fit into such confined space, resulting in use limitation of such ratchet wrench. Accordingly, the technique of increasing the thickness of a ratchet wrench is considered to be a feasible method.

BRIEF SUMMARY OF THE INVENTION

The object of the present invention is to provide a ratchet wrench with an increased thickness in order to improve the overall strength.

To achieve the aforementioned objective, the present invention provides a toggler structure for a ratchet wrench, comprising:

a main body having an accommodating cavity and a receiving slot; the receiving slot arranged at a rear side of the accommodating cavity, and the accommodating cavity connected to the receiving slot;

a ratchet having a central axis and pivotally arranged inside the accommodating cavity; the ratchet having a ratchet teeth portion formed to surround an outer circumference thereof;

a locking member received inside the accommodating cavity and having a locking teeth portion formed at a front end surface thereof to engage with the ratchet teeth portion of the ratchet;

a direction switch member installed inside the receiving slot and located at a rear side of the locking member; the direction switch member having an assembly portion formed at a front end thereof and arranged opposite from the rear end of the locking member;

an elongated toggler arranged between the direction switch member and the locking member and having a length extended along an axial direction of the central axis of the ratchet; the toggler having an abutment portion formed at a front end thereof and engaged with the rear end of the locking member; the toggler having at least two connecting portions formed at a rear end thereof, and the two connecting portions arranged along a length direction of the toggler; and at least two elastic elements arranged along the axial direction of the central axis of the ratchet and located between the assembly portion and the connecting portions; the elastic elements configured to provide an elastic force to push the toggler to abut against the locking member.

Preferably, the connecting portions of the toggler are grooves, and one ends of the elastic elements are received inside the grooves.

Preferably, the connecting portions of the toggler are protrusions, and one ends of the elastic elements are mounted onto the protrusions.

For the toggler structure for a ratchet wrench provided by the present invention, by increasing the axial thickness of the ratchet along the central axis, it is able to increase its strength. In addition, with use of an elongated toggler, it is able to allow the locking member to achieve a relatively comprehensive abutment effect along the axial direction of the central axis of the ratchet, thereby increasing the overall operational strength and torque of the ratchet wrench.

BRIEF DESCRIPTION OF THE SEVERAL VIEWS OF THE DRAWINGS

To further illustrate the objective, features and technical effects of the present invention, three preferred embodiments are described in detail along with the accompanied drawings in the following.

DETAILED DESCRIPTION OF THE INVENTION

Figure 1:
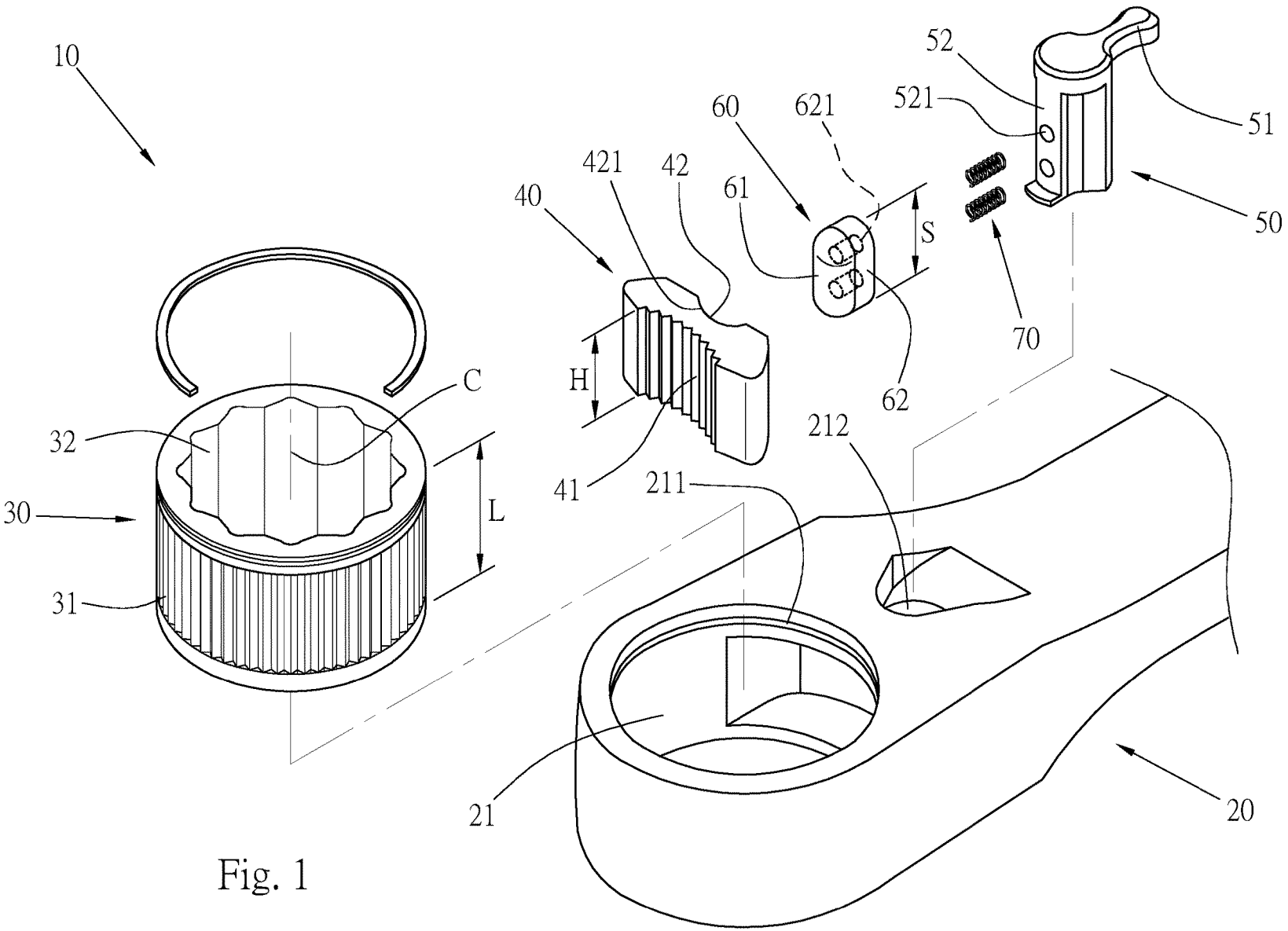
FIG. 1 is a perspective exploded view of the ratchet wrench according to a preferred embodiment of the present invention.
Figure 2:
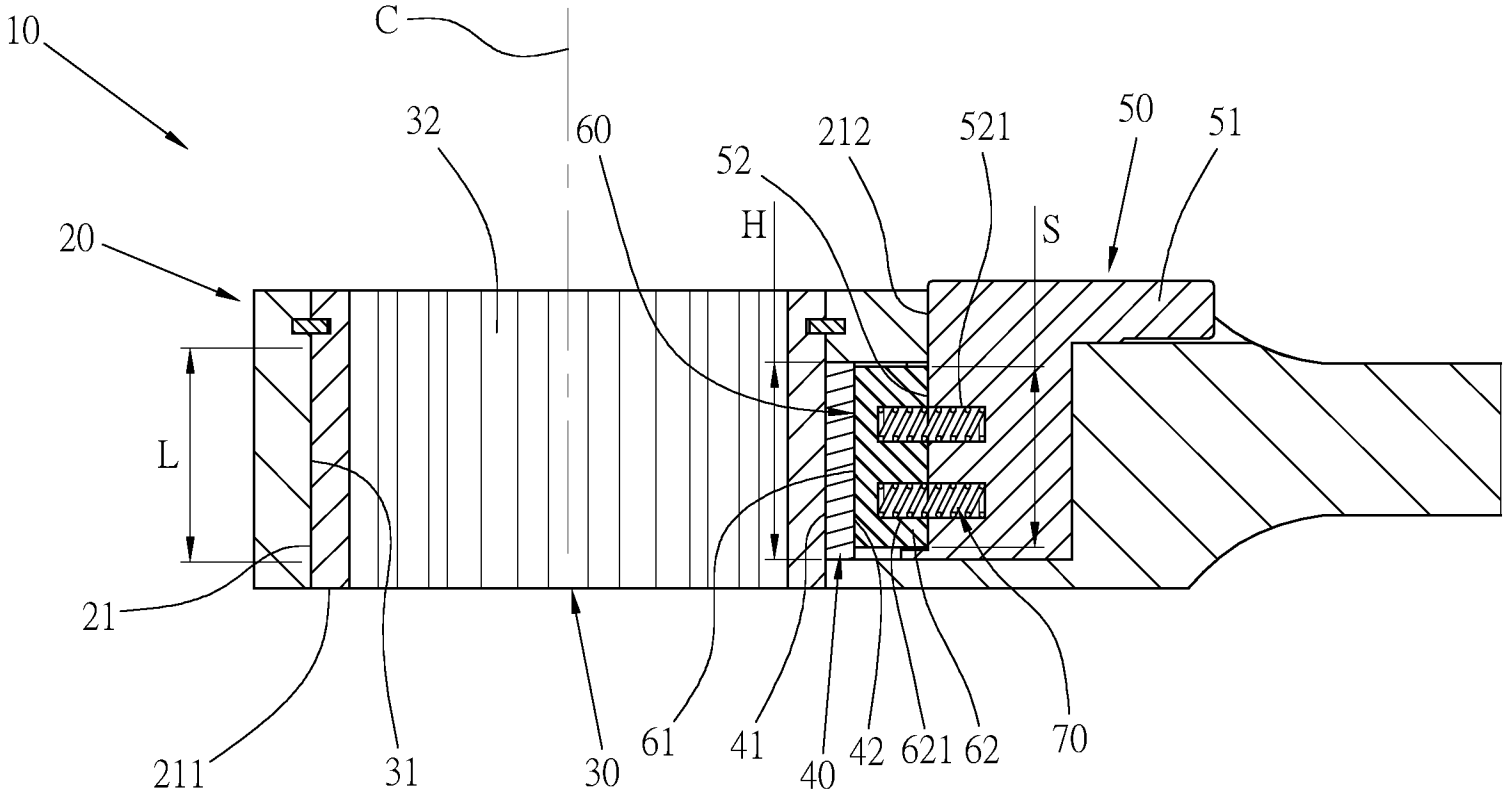
FIG. 2 is a longitudinal cross sectional view of an assembled ratchet wrench shown in FIG. 1.

Please refer to FIG. 1 and FIG. 2, showing a ratchet wrench 10 according to a preferred embodiment of the present invention. The direction of up and down described in this specification shall be based on the direction indicated in the drawings. The front and rear end directions described in this specification shall be based on the direction shown in FIG. 1. The top of FIG. 1 refers to the front end, and the bottom refers to the rear end. The ratchet wrench 10 comprises the following components.

A main body 20 includes an accommodating cavity 21 formed to indent inward at the front end thereof. The front side of the accommodating cavity 21 includes a through hole 211 formed thereon. The top surface of the rear side of the accommodating cavity 21 further includes a receiving slot 212, and the accommodating cavity 21 is connected to the receiving slot 212.

A ratchet 30 is pivotally arranged at a location of the through hole 211 at a front side inside the accommodating cavity 21. The ratchet 30 includes a central axis C, and a ratchet teeth portion 31 is arranged to surround an outer circumference thereof. The ratchet teeth portion 31 includes a length L extended along an axial direction of the central axis C. The ratchet 30 is able to rotate inside the accommodating cavity 21 with the central axis C as the rotational center. The ratchet 30 further includes a working portion 32 formed to intend inward at a center thereof and capable of penetrating through the through hole 211 to be exposed at the external of the main body 20. The working portion 32 can be in the form of a rod or a mounting hole, and the present invention is not limited to any specific form, which is mainly used to engage with a fastener or a sleeve.

A locking member 40 is received inside the accommodating cavity 21 and is located at a rear side of the ratchet 30, and its front end surface includes a locking teeth portion 41 opposite from the end surface of the ratchet 30 in order to engage with the ratchet teeth portion 31. The length of the locking teeth portion 41 is also arranged to extend along the axial direction of the central axis C of the ratchet 30 relatively. By changing the engagement location of the locking teeth portion 41, the rotational direction of the ratchet 30 can be controlled. The rear end of the locking member 40 includes a direction switch portion 42 indented inward thereon, and the direction switch portion 42 is formed to be an arched slot 421.

A direction switch member 50 is installed inside the receiving slot 212. One end of the direction switch member 50 includes a shift rod 51 protruded at an outer side of the main body 20. The direction switch member 50 is located at the rear side of the locking member 40, and the front end of the direction switch member 50 includes an assembly portion 52 opposite from the direction switch portion 42. In this embodiment, the assembly portion 52 is formed to be two grooves 521, and the two grooves 521 are arranged at upper and lower positions along the axial direction of the ratchet 30.

An elongated toggler 60 has a length of S and is arranged along the axial direction of the ratchet 30 in order to allow its length S to be equivalent to the thickness H of the locking member 40. The front end of the toggler 60 includes an abutment portion 61 having an engagement surface in an arched shape and engaged with the arched slot 421 of the direction switch portion 42. The rear end of the toggler 60 opposite from the two grooves 521 of the assembly portion 52 includes two connecting portions 62. In this embodiment, the two connecting portions 62 are two grooves 621 and are arranged at upper and lower sides inside the toggler 60 along the axial direction of the ratchet 30. In addition, the axial length of the direction switch member 50 along the central axis of the ratchet 30 is greater than the length S of the toggler 60 in order to allow the toggler 60 to receive fine support from the direction switch member 50.

Two elastic elements 70 are arranged at upper and lower positions along the axial direction of the ratchet 30, and are received inside the two grooves 521 of the assembly portion 52 of the direction switch member 50 and arranged between the two grooves 621 of the two connecting portions 62 of the toggler 60, and configured to provide an elastic force to push the toggler 60 to abut against the locking member 40. During the operation, as shown in FIGS. 1-8, when the direction switch member 50 is rotated, the toggler 60 is driven to move between the two sides of the accommodating cavity 21 of the main body 20 via the two elastic elements 70, and the toggler 60 drives the locking member 40 to move between the two sides of the accommodating cavity 21.

Figure 4:
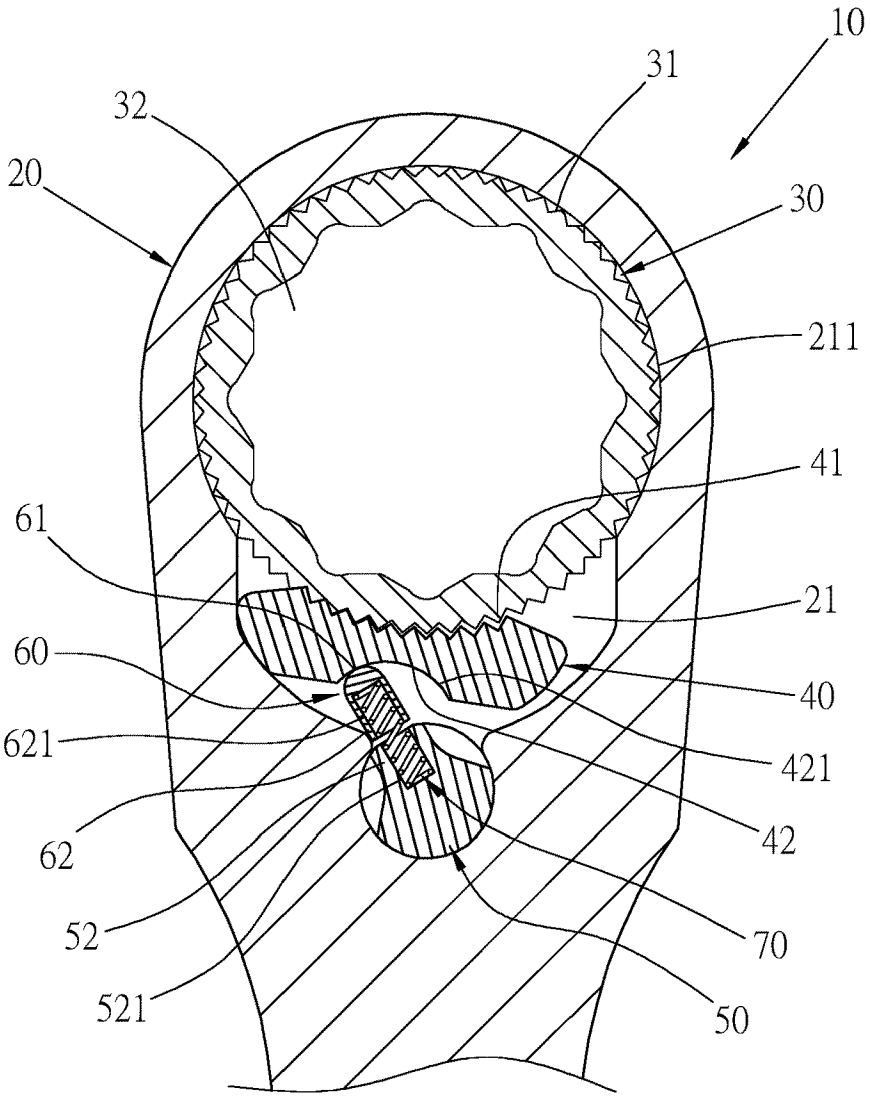
FIG. 4 is an illustration showing an action of the ratchet wrench shown in FIG. 1 pushed in another direction.
Figure 3:
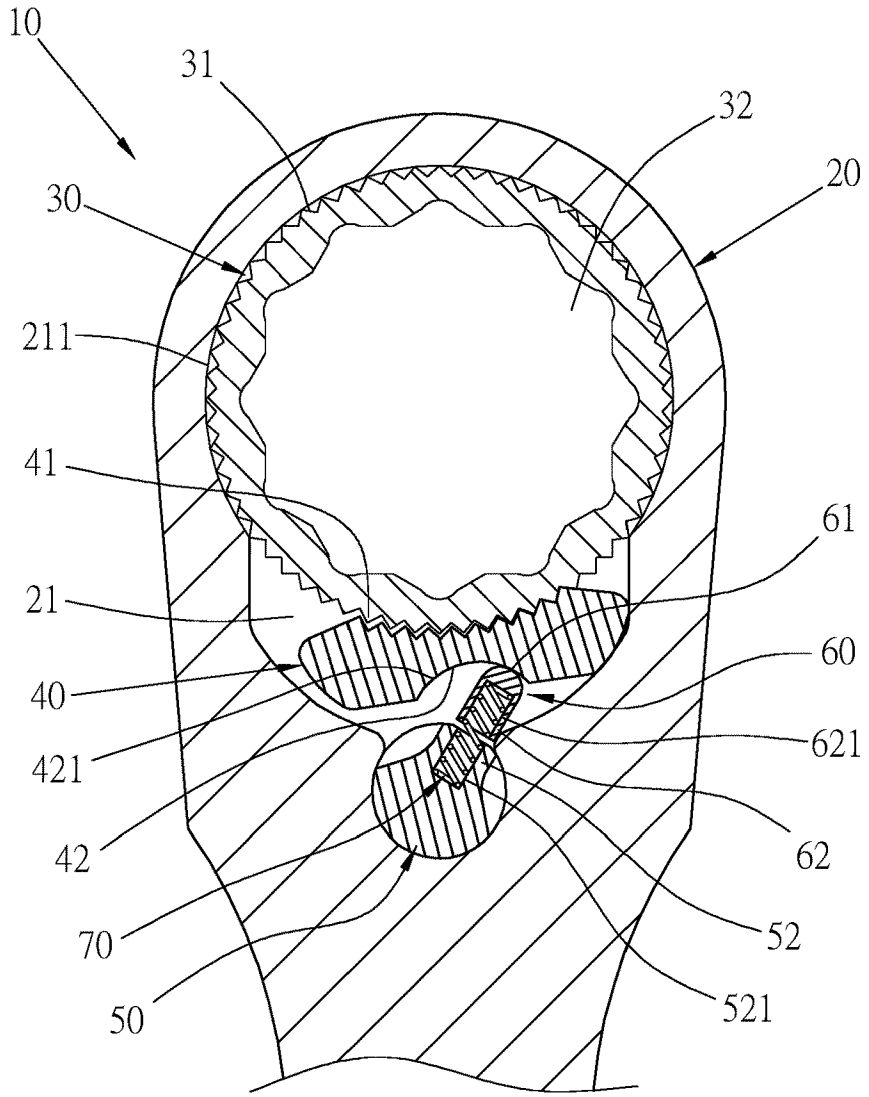
FIG. 3 is an illustration showing an action of the ratchet wrench shown in FIG. 1.

During the operation, as shown in FIGS. 2, 3 and 4, to change the direction of force exertion of the ratchet 30, the shift rod 51 of the direction switch member 50 is shifted in order to allow the assembly portion 52 at the front end of the direction switch member 50 to change direction. The two elastic elements 70 received inside the two grooves 521 of the assembly portion 52 are able to change their directions along with the direction change of the assembly portion 52. At the same time, the toggler 60 on the two elastic elements 70 is also moved along with the actuation of the two elastic elements 70. The toggler 60 is able to change its position at the direction switch portion 42 of the locking member 40 in order to move the locking member 40, thereby allowing the locking teeth portion 41 to engage with the ratchet teeth portion 31 of the ratchet 30 in a different direction. The locking and direction change structure of the ratchet 30 are identical to the known operation; accordingly, details thereof are omitted hereafter.

To increase the overall strength of the ratchet wrench 10, in the present invention, the thicknesses of the main body 20, ratchet 30 and the locking member 40 along the axial direction of the central axis C of the ratchet 30 are increased. With an increased thickness, the overall strength of the ratchet wrench is increased, thereby allowing the overall strength of the wrench and the applicable torque value to be increased relatively. Furthermore, the length S of the toggler 60 of the present invention is also increased in order to allow its length to be equivalent to the thickness H of the direction switch portion 42 of the locking member 40. Moreover, the length L of the ratchet teeth portion 31 of the ratchet 30 and the length (along the axial direction of central axis C) of the locking teeth portion 41 of the locking member 40 are also increased, thereby increasing the engagement strength between the ratchet 30 and the locking member 40 as well as the torque of the wrench. In addition, the connecting portions 62 (two grooves 621) of the toggler 60 are arranged spaced apart from each other along the length direction of the toggler 60, such that the toggler 60 is able to abut against the locking member 40 in a uniform manner. Furthermore, the two elastic elements 70 are arranged spaced apart from each other at upper and lower positions on the toggler 60; therefore, the elastic force at two ends of the toggler 60 can be distributed uniformly, allowing the upper and lower ends of the toggler 60 to elastically abut against the locking member 40 in a uniform manner without concentrating at a certain portion that may cause misalignment of the toggler 60. Accordingly, the toggler 60 of the present invention is able to achieve the most optimal abutment effect on the locking member 40, thereby allowing the locking member 40 and the ratchet 30 to be maintained at the most optimal engagement with each other.

Figure 5:
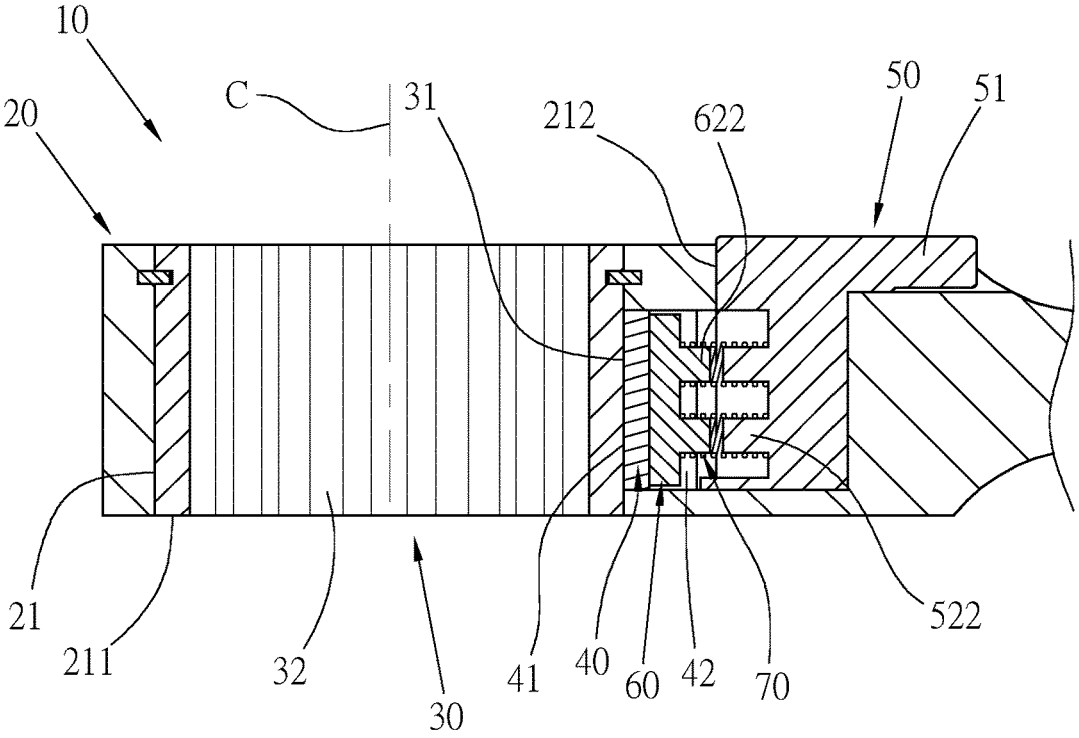
FIG. 5 is a longitudinal cross sectional view of the ratchet wrench according to another preferred embodiment of the present invention.
Figure 7:
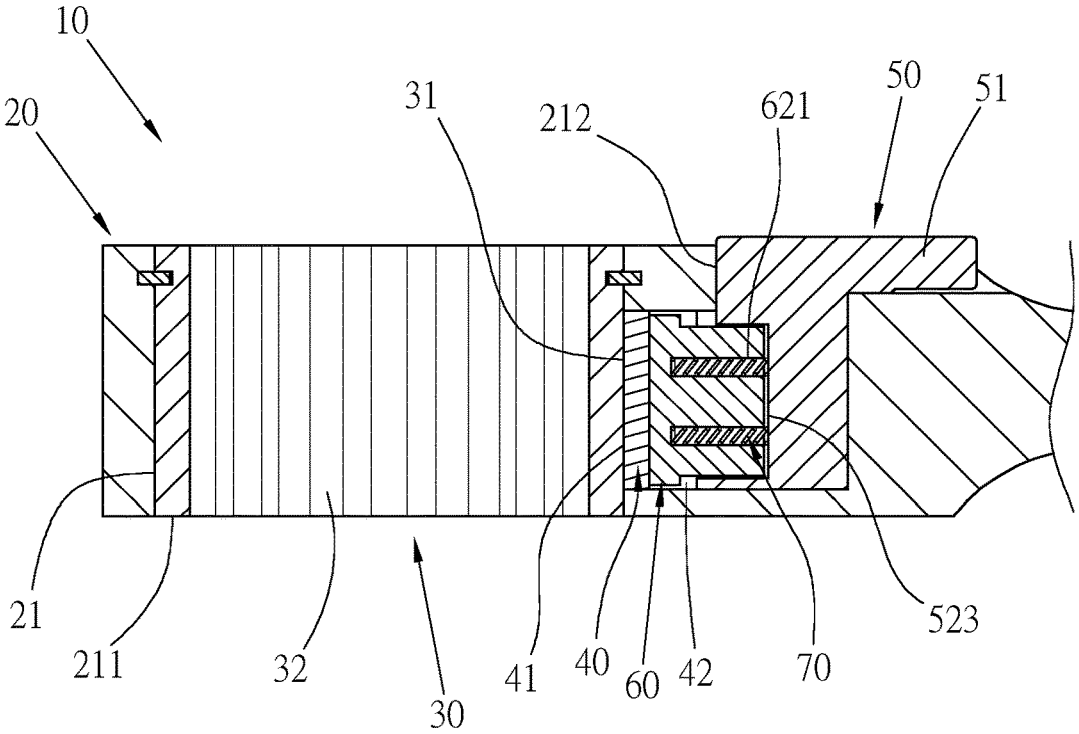
FIG. 7 is a longitudinal cross sectional view of the ratchet wrench according to a third preferred embodiment of the present invention.
Figure 6:
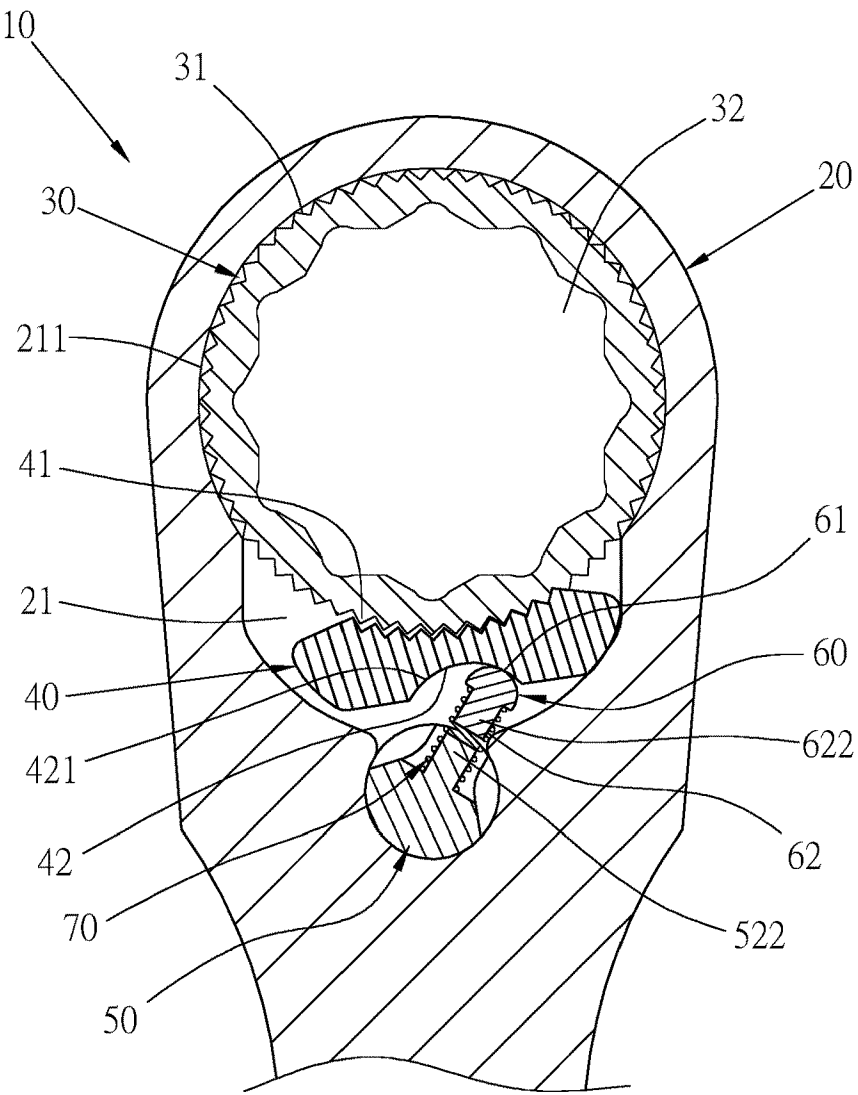
FIG. 6 is an illustration showing an action of the ratchet wrench in FIG. 5.

Please refer to FIG. 5 and FIG. 6, showing another preferred embodiment of a ratchet wrench of the present invention. The main structure of this embodiment is identical to that of the first preferred embodiment, and same structural components use the same component numbers;

therefore, details of identical components are omitted hereafter. The following describes the primary difference between the two embodiments.

The two assembly portions 52 on the direction switch portion 50 are two protrusions 522, and the connecting portions 62 of the toggler 60 are formed by two protrusions 622. The two ends of the two elastic elements 70 are connected to and mounted onto the protrusions 522 of the two assembly portions 52 and the two protrusions 622 of the connecting portions 62 respectively. The grooves 521 or protrusions 522 of the two assembly portions 52 and the grooves 621 or protrusions 622 of the connecting portions 62 can be used in conjunction with each other, and the present invention is not limited to any specific configuration. The main function of the configuration described above is to connect to the two elastic elements 70.

Figure 8:
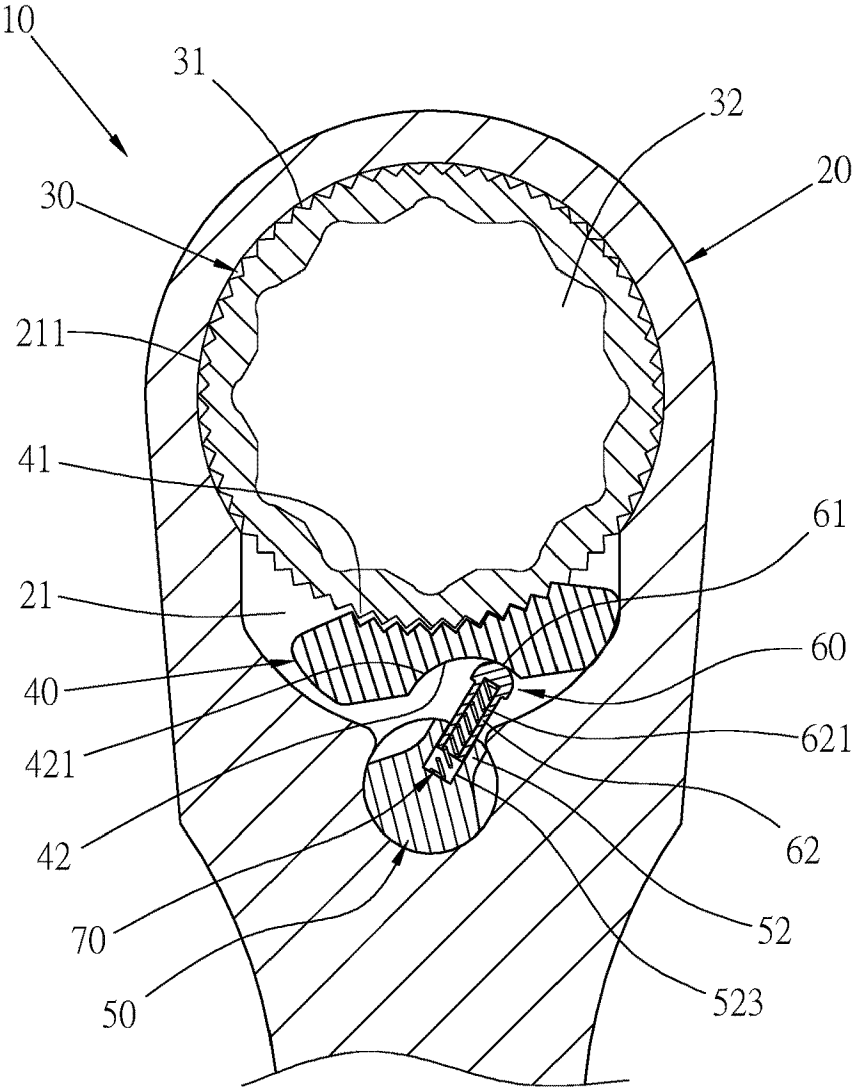
FIG. 8 is an illustration showing an action of the ratchet wrench in FIG. 7.

Please refer to FIG. 1 and FIG. 8, showing a third preferred embodiment of a ratchet wrench of the present invention. The main structure of this embodiment is identical to that of the first preferred embodiment, and same structural components use the same component numbers; therefore, details of identical components are omitted hereafter. The following describes the primary difference between the two embodiments.

The assembly portion 52 of the direction switch member 50 is formed by an elongated slot 523 in order to allow the rear end of the toggler 60 to be directly received inside the elongated slot 523 together with the two elastic elements 70. The two ends of the two elastic elements 70 abut against the direction switch member 50 and the two grooves 621 of the connecting portion 62 respectively.

For a ratchet wrench provided by the present invention, its ratchet and locking member are of an increased thickness along the axial direction of the central axis of the ratchet. The increased thickness is able to relatively increase its strength and torque value. In addition, with the toggler having a length structure formed along the axial direction of the central axis of the ratchet, in comparison to a known toggler, the toggler of the present invention is able to achieve a fine supporting effect for the ratchet and locking member of a greater thickness. Furthermore, by arranging the two elastic elements at upper and lower portions of the toggler, the toggler is able to generate a uniform elastic force in order to allow the toggler to support the locking member properly.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention

What is claimed is:

1. A toggler structure for a ratchet wrench, comprising:

a main body having an accommodating cavity and a receiving slot; the receiving slot arranged at a rear side of the accommodating cavity, and the accommodating cavity connected to the receiving slot;

a ratchet having a central axis and pivotally arranged inside the accommodating cavity; the ratchet having a ratchet teeth portion formed to surround an outer circumference thereof; the ratchet teeth portion having a length extended along a direction of the central axis; the ratchet configured to rotate inside the accommodating cavity with the central axis as a rotational center;

a locking member received inside the accommodating cavity and having a locking teeth portion formed at a front end surface thereof to engage with the ratchet teeth portion of the ratchet;

a direction switch member installed inside the receiving slot and located at a rear end of the locking member; the direction switch member having an assembly portion formed at a front end thereof and arranged opposite from the rear end of the locking member;

a toggler being elongated and arranged between the direction switch member and the locking member and having a length extended along an axial direction of the central axis of the ratchet; the toggler having an abutment portion formed at a front end thereof and engaged with the rear end of the locking member; the toggler having two connecting portions formed at a rear end thereof and spaced a predetermined distance from lateral edges the rear end of the toggler, and the two connecting portions arranged along a length direction of the toggler; and two elastic elements arranged along the axial direction of the central axis of the ratchet and located between the assembly portion and the connecting portions; the elastic elements configured to provide an elastic force to push the toggler to abut against the locking member;

wherein, when the direction switch member is rotated, the toggler is driven to move between the two sides of the accommodating cavity of the main body via the two elastic elements, and the toggler drives the locking member to move between the two sides of the accommodating cavity;

wherein the rear end of the toggler is not mounted in the front end of the direction switch member, the toggler is wholly located on an exterior of the direction switch member.

2. The toggler structure for the ratchet wrench as claimed in claim 1, wherein the assembly portion of the direction switch member includes two grooves, and one end of the two elastic elements are received inside the two grooves.

3. The toggler structure for the ratchet wrench as claimed in claim 1, wherein the assembly portion of the direction switch member includes two protrusions, and end of the two elastic elements are mounted onto the two protrusions.

4. The toggler structure for the ratchet wrench as claimed in claim 1, wherein the assembly portion of the direction switch member is formed by an elongated slot, and the rear end of the toggler and one ends of the elastic elements are received inside the elongated slot.

5. The toggler structure for the ratchet wrench as claimed in claim 1, wherein an axial length of the direction switch member along the central axis of the ratchet is longer than the length of the toggler.

6. The toggler structure for the ratchet wrench as claimed in claim 1, wherein the abutment portion is an arched shape.

7. The toggler structure for the ratchet wrench as claimed in claim 1, wherein the connecting portions of the toggler are grooves, and one end of each elastic element of the two elastic elements is inserted into a corresponding groove of the two grooves.

8. The toggler structure for the ratchet wrench as claimed in claim 7, wherein the assembly portion of the direction switch member includes two grooves, and end of the two elastic elements are received inside the two grooves.

9. The toggler structure for the ratchet wrench as claimed in claim 7, wherein the assembly portion of the direction switch member includes two protrusions, and one end of the two elastic elements are mounted onto the two protrusions.

10. The toggler structure for the ratchet wrench as claimed in claim 7, wherein the assembly portion of the direction switch member is formed by an elongated slot, and the rear end of the toggler and one ends of the elastic elements are received inside the elongated slot.

11. The toggler structure for the ratchet wrench as claimed in claim 1, wherein the connecting portions of the toggler are two protrusions, and one end of the two elastic elements are mounted onto the two protrusions.

12. The toggler structure for the ratchet wrench as claimed in claim 11, wherein the assembly portion of the direction switch member includes two grooves, and end of the two elastic elements are received inside the two grooves.

13. The toggler structure for the ratchet wrench as claimed in claim 11, wherein the assembly portion of the direction switch member includes two protrusions, and end of the two elastic elements are mounted onto the two protrusions.

14. The toggler structure for the ratchet wrench as claimed in claim 11, wherein the assembly portion of the direction switch member is formed by an elongated slot, and the rear end of the toggler and one ends of the elastic elements are received inside the elongated slot.

* * * * *